US009173016B2

(12) United States Patent
Koehler et al.

(10) Patent No.: US 9,173,016 B2
(45) Date of Patent: Oct. 27, 2015

(54) HEADSET

(71) Applicant: Sennheiser electronic GmbH & Co. KG, Wedemark (DE)

(72) Inventors: Mathias Koehler, Herzogenrath (DE); Joerg Buchberger, Peine (DE)

(73) Assignee: Sennheiser electronic GmbH & Co. KG, Wedemark (DE)

( * ) Notice: Subject to any disclaimer, the term of this patent is extended or adjusted under 35 U.S.C. 154(b) by 0 days.

(21) Appl. No.: 13/962,054

(22) Filed: Aug. 8, 2013

(65) Prior Publication Data

US 2014/0146990 A1 May 29, 2014

(30) Foreign Application Priority Data

Aug. 10, 2012 (DE) ..... 10 2012 214 306

(51) Int. Cl.
*H04R 25/00* (2006.01)
*H04R 1/10* (2006.01)
*H04R 5/033* (2006.01)

(52) U.S. Cl.
CPC ..... *H04R 1/10* (2013.01); *H04R 1/1041* (2013.01); *H04R 5/033* (2013.01)

(58) Field of Classification Search
CPC ..... H04R 1/10; H04R 2201/10; H04M 1/05; H04M 1/0258; H04M 1/6058
USPC ..... 381/74, 370, 384; 379/430; 455/575.2, 455/345
See application file for complete search history.

(56) References Cited

U.S. PATENT DOCUMENTS

| | | | | |
|---|---|---|---|---|
| 5,318,503 | A | 6/1994 | Lord | |
| 5,717,818 | A * | 2/1998 | Nejime et al. | 704/211 |
| 2003/0223602 | A1 * | 12/2003 | Eichler et al. | 381/309 |
| 2006/0094481 | A1 * | 5/2006 | Gullickson | 455/575.2 |
| 2006/0287786 | A1 * | 12/2006 | Todd | 701/35 |
| 2007/0116316 | A1 * | 5/2007 | Goldberg | 381/370 |
| 2008/0032663 | A1 * | 2/2008 | Doyle | 455/345 |
| 2008/0311966 | A1 * | 12/2008 | Klein | 455/575.2 |

FOREIGN PATENT DOCUMENTS

WO WO 2008/014214 1/2008

* cited by examiner

*Primary Examiner* — Tuan D Nguyen
(74) *Attorney, Agent, or Firm* — Frommer Lawrence & Haug LLP

(57) ABSTRACT

There is provided a headset, in particular an aviation headset, having an input for receiving audio signals, an audio storage means for at least temporarily storing audio signals received by way of the input, an output unit for output of the received audio signals to at least one electroacoustic reproduction transducer and an operating unit for releasing audio signals stored in the audio storage means.

8 Claims, 1 Drawing Sheet

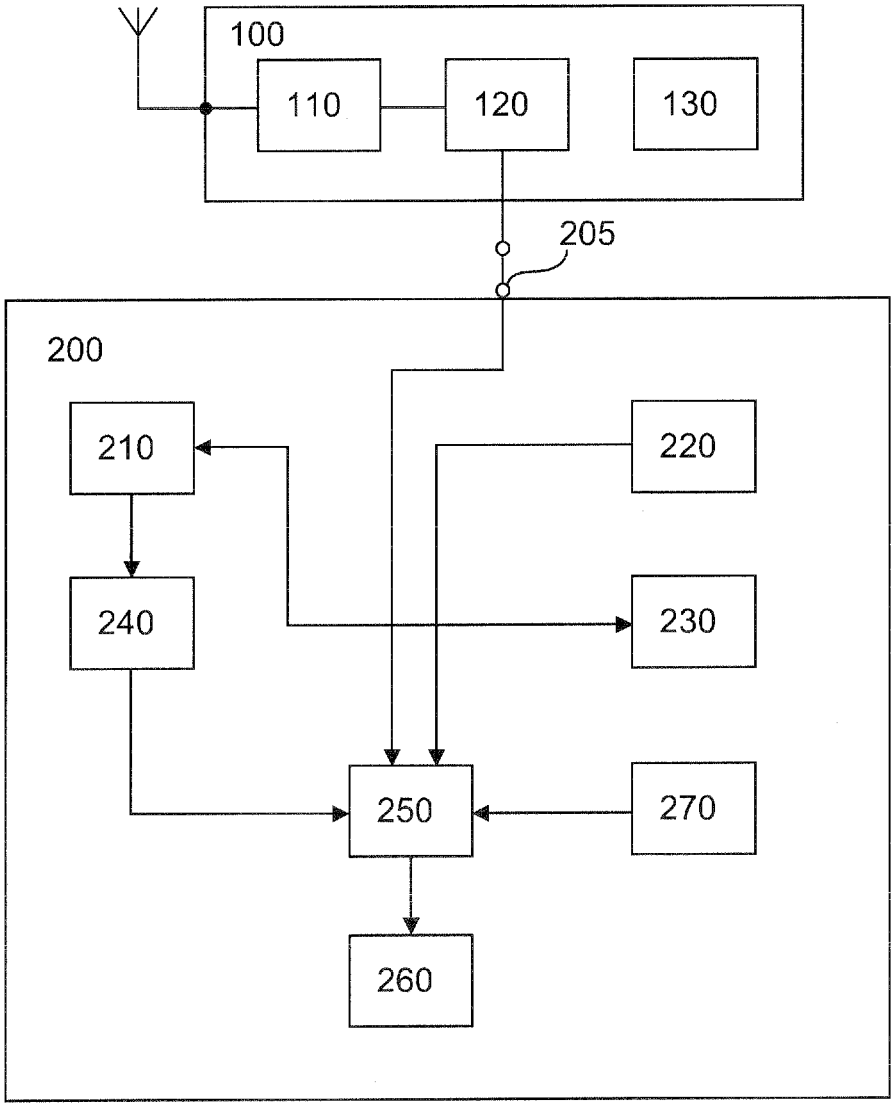
100
110
120
130
205
200
210
220
240
230
250
270
260

HEADSET

The present application claims priority from German Patent Application No. DE 10 2012 214 263.0 filed on Aug. 10, 2012, the disclosure of which is incorporated herein by reference in its entirety.

FIELD OF THE INVENTION

The present invention concerns a headset.

It is noted that citation or identification of any document in this application is not an admission that such document is available as prior art to the present invention.

Headsets are used for example in the aviation field for communication between a pilot and air traffic control.

Because of the background noise and the in part poor quality of the headsets used comprehensibility of the communication between a pilot and air traffic control is sometimes inadequate.

In the German application from which priority is claimed the German Patent and Trade Mark Office searched the following documents: U.S. Pat. No. 5,318,503 and WO 2008/014214 A2.

It is noted that in this disclosure and particularly in the claims and/or paragraphs, terms such as "comprises", "comprised", "comprising" and the like can have the meaning attributed to it in U.S. patent law; e.g., they can mean "includes", "included", "including", and the like; and that terms such as "consisting essentially of" and "consists essentially of" have the meaning ascribed to them in U.S. patent law, e.g., they allow for elements not explicitly recited, but exclude elements that are found in the prior art or that affect a basic or novel characteristic of the invention.

It is further noted that the invention does not intend to encompass within the scope of the invention any previously disclosed product, process of making the product or method of using the product, which meets the written description and enablement requirements of the USPTO (35 U.S.C. 112, first paragraph) or the EPO (Article 83 of the EPC), such that applicant(s) reserve the right to disclaim, and hereby disclose a disclaimer of, any previously described product, method of making the product, or process of using the product.

SUMMARY OF THE INVENTION

Therefore the object of the present invention is to provide a headset which contributes to increasing the comprehensibility of communication.

Thus there is provided a headset, in particular an aviation headset, having an input for receiving audio signals, an audio storage means for at least temporarily storing audio signals received by way of the input, an output unit for output of the received audio signals to at least one electroacoustic reproduction transducer and an operating unit for releasing audio signals stored in the audio storage means.

In an aspect of the present invention reproduction of an audio signal stored in the audio storage means is stopped or interrupted when a fresh audio signal is received at the input.

In a further aspect of the invention reproduction of the audio signal stored in the audio storage means and interrupted is continued when reception of the current audio signal by way of the input is ended.

In a further aspect of the invention the output unit is adapted to increase the volume of reproduction of an audio signal stored in the audio storage means in the event of a repeated reproduction after actuation of the operating element.

In a further aspect of the invention a longer actuation of the operating element leads to erasure at least of a part of the audio signals stored in the audio storage means.

The present invention concerns the notion of storing the received audio signals at least temporarily so that the user can listen to those audio signals or speech signals again if he has not understood the communicated audio signal or the communicated speech signal. For that purpose, provided in a headset is a storage means for storage of the audio signals. Preferably the audio signals are stored only for a short time or the storage means has only a limited capacity, corresponding to a given recording duration. With such a headset, it is possible for the reliability or comprehensibility of a communication for example between a pilot and the air traffic control to be improved as the pilot or the air traffic controllers have the option of listening to the last radio message again. In that way it is possible to reduce difficulties in understanding as between the pilot and the air traffic control.

BRIEF DESCRIPTION OF THE DRAWINGS

FIG. 1 shows a block circuit diagram of a cockpit and a headset according to the invention.

DETAILED DESCRIPTION OF EMBODIMENTS

It is to be understood that the figures and descriptions of the present invention have been simplified to illustrate elements that are relevant for a clear understanding of the present invention, while eliminating, for purposes of clarity, many other elements which are conventional in this art. Those of ordinary skill in the art will recognize that other elements are desirable for implementing the present invention. However, because such elements are well known in the art, and because they do not facilitate a better understanding of the present invention, a discussion of such elements is not provided herein.

The present invention will now be described in detail on the basis of exemplary embodiments.

FIG. 1 shows a block circuit diagram of a cockpit and a headset according to the invention. FIG. 1 shows a cockpit 100 of an aircraft and a headset 200. The cockpit 100 can have for example a radio interface 110, an intercom unit 120 and a voltage supply 130. By means of the radio interface 110 for example a radio message can be acquired and demodulated by an air traffic control. The demodulated radio signal can then be outputted to the headset 200 by means of the intercom unit 120. Typically the headset 200 has a cable with a plug which can be introduced into a jack on the cockpit 100. As an alternative thereto the connection can be wireless.

The headset 200 has an operating element 210, optionally an active noise compensation unit 220, a control unit 230, an audio storage unit 240, an output unit 250 and at least one electroacoustic reproduction transducer 260.

Optionally the active noise compensation unit 220 and the control unit 230 can be implemented in a digital signal processing unit. Optionally that digital signal processing unit can also have the audio storage means 240.

The audio signal from the intercom unit 120 of the cockpit 100 is passed to the output unit 250. Optionally active noise compensation can be implemented by the active noise compensation unit 220. The compensation signal of the active noise compensation unit 220 is also fed to the output unit 250. The output unit 250 can have for example an audio amplifier.

The audio signal from the intercom unit 120 can be at least temporarily stored according to the invention in the audio storage means 240. The audio storage means 240 can for example be in the form of a ring storage means with a limited storage capacity so that only the radio messages can be stored there over a certain period of time. By actuation of the operating unit 210 for example the last radio message stored in the audio storage means 240 is outputted to the output unit 250 which in turn passes the audio signal to the electroacoustic reproduction transducer 260.

The audio storage means 240 can also be adapted to record and store not only the communication from the air traffic control center but also the communication from other headsets in the aircraft, for example of the co-pilot or the like.

Optionally the recording time of the audio storage means 240 can be limited to 20 seconds. A longer or a shorter recording time however is also possible.

In an aspect of the invention reproduction of the radio message recorded in the audio storage means 240 is interrupted when a new radio message is received by the radio interface 110. In that case firstly the current radio message is reproduced at the electroacoustic reproduction transducer 260. Optionally the recording time can be so selected that at least two radio messages can be recorded, exactly as there can be adequate separation between the radio messages.

Optionally the audio signal received by the radio interface and the audio signal later stored in the audio storage means 240 can be reproduced at a level of 95 dB SPL±6 dB at 1 kHz and 1 mW.

In an aspect of the invention the headset has an adjusting unit 270, by means of which the level of reproduction, the frequency of reproduction and the power of reproduction at the output unit can be adjusted. That can be effected for example by way of electric potentiometers which are adjustable through an opening in the housing of the headset by means of a screwdriver. Optionally the headset can have a compressor unit and an amplifier to lift the signal to the desired SPL.

The voltage supply of the headset can be ensured by way of dedicated batteries or by way of the power supply 130 in the cockpit.

The operating element 210 can be provided in the form of a button or slider on the housing of the headset. Preferably the haptic means of the button is of such a nature that the button is quick to find. Optionally the operating element can give a tactile feedback to the operator. Thus the headset can be readily operated for reproduction of the stored radio messages without the user having to see the button.

A different way of operating the operating element 210 can lead to different results. In that case a brief press on the button or brief actuation of the operating element 210 can trigger playback of a radio message. Renewed pressure on the button can stop playback of the recording. Renewed pressure on the button can provide that the radio message is reproduced again from the start. A longer pressure on the button of for example 2 seconds or more can result in erasure of the radio message.

As already described above the headset according to the invention can interrupt the reproduction of a recorded radio message when a current radio message is received. In such a case either reproduction of the recorded radio message is ended or the volume is reduced while reproduction of the current radio message takes place at the normal volume.

After the current radio message has been received the last recorded radio message that the pilot has just listened to can be automatically reproduced. Optionally the radio message can be briefly wound back before it is reproduced.

In a further aspect of the invention brief actuation of the operating element can result in playback of a first recording or radio message. If the operating unit is actuated twice then the second recording or the second radio message can be played back. When the button is pressed again reproduction of the current radio message is stopped. When the operating unit 210 is actuated again then the first radio message or the first recording can be reproduced from the start. Upon double brief renewed actuation 210 the second recording or the second radio message can be reproduced from the start. Upon longer actuation of the operating element, for example two seconds or longer, the current recordings or radio messages are erased.

In a further aspect of the invention the operating element can also be in the form of a touch screen or touch pad. In that case it is possible to use gesture control for controlling reproduction of the audio signals stored in the audio storage means 240. For example swiping a finger rearwardly can cause rewinding of the radio message or the recording. Faster swiping can lead to rewinding of the recording. A (fast) swipe forwardly can permit immediate return to the current signal.

In a further aspect of the invention the operating element can be in the form of a rotary knob with an eccentric recess. The recess can be used to place a finger there in order to rotate the knob and thus permit forward or reverse winding of the radio signal to be reproduced or navigation within the storage means.

In a further aspect of the invention the volume can be increased upon repeat of the reproduction of a recording. Optionally the volume can be increased in each repeat. If the operating element 210 is in the form of a touch pad then swiping upwardly can cause an increase in volume and swiping downwardly can cause a reduction in volume. Swiping rearwardly and upwardly can thus cause both an increase in volume and also renewed reproduction of the radio message to be reproduced.

The audio storage means and/or the control unit can analyze the recorded radio messages and skip pauses which may be present.

In a further aspect of the invention a marking can be placed at a commencement of a radio signal in the audio storage means so as to be able to ensure that the radio message is always reproduced from the beginning.

In a further aspect of the invention for example there can be provided a speech recognition unit in the control unit or in the audio storage means, which detects a commencement of a radio message for example on the basis of the call sign of the aircraft and there optionally identifies the beginning of the audio signal.

While this invention has been described in conjunction with the specific embodiments outlined above, it is evident that many alternatives, modifications, and variations will be apparent to those skilled in the art. Accordingly, the preferred embodiments of the invention as set forth above are intended to be illustrative, not limiting. Various changes may be made without departing from the spirit and scope of the inventions as defined in the following claims.

The invention claimed is:

1. A headset, in particular an aviation headset comprising:

at least one electroacoustic reproduction transducer;

an input configured to receive audio signals;

an audio storage means configured to at least temporarily store audio signals received by way of the input;

an output unit configured to output the received audio signals to the at least one electroacoustic reproduction transducer; and an operating unit configured to release audio signals stored in the audio storage means upon actuation such that the stored audio signals are reproduced again by the at least one electroacoustic reproduction transducer;

wherein the output unit is adapted to automatically increase a volume of reproduction, through the electroacoustic reproduction transducer, of an audio signal stored in the audio storage means in the event of a repeated reproduction after actuation of the operating unit.

2. The headset as set forth in claim 1;

wherein reproduction of an audio signal stored in the audio storage means is stopped or interrupted when a fresh audio signal is received at the input.

3. The headset as set forth in claim 2;

wherein reproduction of the audio signal stored in the audio storage means and interrupted is continued when reception of the current audio signal by way of the input is ended.

4. The headset as set forth in claim 1;

wherein the headset is configured so that a longer actuation of the operating unit leads to erasure at least of a part of the audio signals stored in the audio storage means.

5. The headset as set forth in claim 1;

wherein the audio storage means is in the form of a ring storage means with limited storage capacity so that radio messages are stored in the audio storage means only over a period and are then replaced by fresh radio messages.

6. The headset as set forth in claim 1;

wherein the headset is configured to be utilized in an aircraft, with the audio storage means being adapted to store not only a communication with an air traffic control but also a communication with another headset in the aircraft.

7. The headset as set forth in claim 1;

wherein the headset is adapted to output the stored audio signals at a level of 95 dB sound pressure level ("SPL") ±6 dB at 1 kHz and 1 mW.

8. The headset as set forth in claim 1;

wherein the operating unit comprises an operating element arranged on a housing of the headset; and wherein the operating element has a haptic means in order to quickly find the operating element.

* * * * *